US010334390B2

(12) United States Patent
Bakish et al.

(10) Patent No.: US 10,334,390 B2
(45) Date of Patent: Jun. 25, 2019

(54) METHOD AND SYSTEM FOR ACOUSTIC SOURCE ENHANCEMENT USING ACOUSTIC SENSOR ARRAY

(71) Applicants: Idan Bakish, Petah-Tikva (IL); Boaz Schwartz, Rishon LeTsion (IL)

(72) Inventors: Idan Bakish, Petah-Tikva (IL); Boaz Schwartz, Rishon LeTsion (IL)

( * ) Notice: Subject to any disclaimer, the term of this patent is extended or adjusted under 35 U.S.C. 154(b) by 0 days.

(21) Appl. No.: 15/571,339

(22) PCT Filed: May 5, 2016

(86) PCT No.: PCT/IL2016/050475
§ 371 (c)(1),
(2) Date: Nov. 2, 2017

(87) PCT Pub. No.: WO2016/178231
PCT Pub. Date: Nov. 10, 2016

(65) Prior Publication Data

US 2018/0115855 A1 Apr. 26, 2018

Related U.S. Application Data

(60) Provisional application No. 62/157,608, filed on May 6, 2015.

(51) Int. Cl.
*H04R 3/00* (2006.01)
*H04R 29/00* (2006.01)
(Continued)

(52) U.S. Cl.
CPC ..... *H04S 7/305* (2013.01); *H04R 1/265* (2013.01); *H04R 1/406* (2013.01); *H04R 3/005* (2013.01);
(Continued)

(58) Field of Classification Search
CPC ..... H04R 3/00; H04R 3/005; H04R 3/008; H04R 1/265; H04R 1/406;
(Continued)

(56) References Cited

U.S. PATENT DOCUMENTS 6,259,792 B1 7/2001 Lambrecht
7,039,546 B2 * 5/2006 Sawada ..... G01S 3/46 702/150

(Continued)

FOREIGN PATENT DOCUMENTS

WO 2014177855 A1 11/2014

OTHER PUBLICATIONS

Affes Sofiene and Grenier Yves,"A Signal Subspace Tracking Algorithm for Microphone Array Processing of Speech", IEEE Transactions on Speech and Audio Processing, pp. 435-437 vol. 5 No. 5(Sep. 1997).

(Continued)

*Primary Examiner* — Thang V Tran
(74) *Attorney, Agent, or Firm* — Browdy and Neimark, PLLC

(57) ABSTRACT

Method and system for enhancing acoustic performances in an adverse acoustic environment, where the system comprises: an array of acoustic sensors having different directivities; and an analysis module being configured for optimizing signal enhancement of at least one source, by correlating the sensors according to respective position of the at least one source in respect to the directivity of the acoustic sensors, based on reflections from reverberating surfaces in the specific acoustic environment, wherein the optimization and sensors directivity allows maintaining the sensor array in compact dimensions without affecting signal enhancement and source separation.

20 Claims, 7 Drawing Sheets

(51) Int. Cl.

| | |
|---|---|
| ***H04S 7/00*** | (2006.01) |
| ***H04R 1/40*** | (2006.01) |
| ***H04R 1/26*** | (2006.01) |
| ***H04S 3/00*** | (2006.01) |

(52) U.S. Cl.
CPC ..... *H04S 3/008* (2013.01); *H04R 2201/401* (2013.01); *H04R 2227/007* (2013.01); *H04S 2400/01* (2013.01); *H04S 2400/15* (2013.01)

(58) Field of Classification Search
CPC ..... H04R 2201/401; H04R 29/00; H04R 29/005; H04R 2227/007; H04S 3/008; H04S 7/305; H04S 2400/01; H04S 2400/15
See application file for complete search history.

(56) References Cited

U.S. PATENT DOCUMENTS

| | | | | |
|---|---|---|---|---|
| 7,809,145 | B2 | 10/2010 | Mao | |
| 8,005,237 | B2 | 8/2011 | Tashev et al. | |
| 8,204,247 | B2 | 6/2012 | Elko et al. | |
| 8,958,572 | B1 | 2/2015 | Solbach | |
| 9,928,847 | B1 * | 3/2018 | Cleve | G10L 21/0208 |
| 2002/0079437 | A1 * | 6/2002 | Paritsky | H04R 23/008 250/231.1 |
| 2007/0021958 | A1 | 1/2007 | Visser et al. | |
| 2007/0110257 | A1 | 5/2007 | Dedieu | |
| 2010/0265799 | A1 | 10/2010 | Cevher et al. | |
| 2012/0197636 | A1 | 8/2012 | Benesty et al. | |
| 2013/0039503 | A1 * | 2/2013 | Beaucoup | H04R 3/005 381/66 |
| 2013/0287225 | A1 * | 10/2013 | Niwa | H04R 3/00 381/92 |
| 2013/0343571 | A1 * | 12/2013 | Rayala | H04R 3/005 381/92 |
| 2014/0056435 | A1 * | 2/2014 | Kjems | G10L 15/20 381/66 |
| 2014/0204714 | A1 * | 7/2014 | Sato | G01S 3/808 367/117 |
| 2016/0192068 | A1 * | 6/2016 | Ng | H04R 1/406 381/92 |
| 2016/0212554 | A1 * | 7/2016 | Chafe | H04R 29/00 |
| 2017/0374317 | A1 * | 12/2017 | Sun | H04N 7/147 |
| 2017/0374474 | A1 * | 12/2017 | Hoekstra | H04R 19/005 |

OTHER PUBLICATIONS

Jan Ea-Ee and Flanagan James,"Sound Capture from spatial Volumes Matched-Filter Processing of Microphone Arrays Having Randomly Distributed Sensors", pp. 917-920 (1996).

Capon, J., "High-resolution frequency-wavenumber spectrum analysis". Proceedings of the IEEE 57, pp. 1408-1418 (1969).

* cited by examiner

METHOD AND SYSTEM FOR ACOUSTIC SOURCE ENHANCEMENT USING ACOUSTIC SENSOR ARRAY

FIELD OF THE INVENTION

The present invention generally relates to systems and methods for speech enhancement using acoustic sensor arrays.

BACKGROUND OF THE INVENTION

Speech enhancement using microphone arrays is a known in the art technique, in which the microphones are typically arranged in a line for synchronizing the delays thereof according to distance of each microphone from the speaker, such as shown in FIGS. 1-2. In these techniques the output of the microphones is delayed in a controllable manner to allow synchronizing the speaker's speech and eliminating other noise related signals. These techniques require the microphones to be substantially separated from one another i.e. forming a large distance from one another or the delaying is insignificant and cannot be used for speech enhancement.

The formula for a homogenous linear array beam pattern is:

$$D(\theta) = \frac{\sin[N\pi\cos(\theta)\cdot\lambda^{-1}d]}{\sin[\pi\cos(\theta)\cdot\lambda^{-1}d]}$$

and the response function (attenuation in dB) is given in the graph shown in FIG. 2.

Affes et al. (1997) teaches a signal subspace tracking algorithm for microphone array speech processing for enhancing speech in adverse acoustic environments. This algorithm proposes a method of adaptive microphone array beamforming using matched filters with signal subspace tracking for enhancement of near field speech signals by the reduction of multipath and reverberations. This method is mainly targeted at reducing the reflections and reverberations of sound sources that do not propagate along direct paths such as in cases of microphones of hand held mobile devices. The setup that was used in this work by Affes et al. (1997) is discussed at Sec. II.A. Twelve microphones were positioned on the screen of a computer workstation, with spacing of 7 cm between each pair.

Jan et al (1996) teaches microphone arrays and signal processing for high quality sound capture in noisy reverberant enclosures that incorporates matched filtering of individual sensors and parallel processing for providing spatial volume selectivity that mitigates noise interference and multipath distortion. This technique uses randomly distributed transducers.

Capon (1969) teaches a high-resolution frequency-wave-number spectrum analysis, which is referred to as the minimum variance distortionless response (MVDR) beamformer. This well-known algorithm is used to minimize the noise received by a sensor array, while preserving the desired source without distortion.

U.S. Pat. No. 7,809,145 teaches methods and apparatus for signal processing. A discrete time domain input signal xm(t) is produced from an array of microphones M0 . . . MM. A listening direction may be determined for the microphone array. The listening direction is used in a semi-blind source separation to select the finite impulse response filter coefficients b0, b1 . . . , bN to separate out different sound sources from input signal xm(t). One or more fractional delays may optionally be applied to selected input signals xm(t) other than an input signal x0(t) from a reference microphone M0.

U.S. Pat. No. 8,204,247 teaches an audio system generates position-independent auditory scenes using harmonic expansions based on the audio signals generated by a microphone array. Audio sensors are mounted on the surface of a sphere. The number and location of the audio sensors on the sphere are designed to enable the audio signals generated by those sensors to be decomposed into a set of eigenbeam outputs. Compensation data corresponding to at least one of the estimated distance and the estimated orientation of the sound source relative to the array are generated from eigenbeam outputs and used to generate an auditory scene. Compensation based on estimated orientation involves steering a beam formed from the eigenbeam outputs in the estimated direction of the sound source to increase direction independence, while compensation based on estimated distance involves frequency compensation of the steered beam to increase distance independence.

U.S. Pat. No. 8,005,237 teaches beamforming post-processor technique with enhanced noise suppression capability. The beam forming post-processor technique is a non-linear post-processing technique for sensor arrays (e.g., microphone arrays) which improves the directivity and signal separation capabilities. The technique works in so-called instantaneous direction of arrival space, estimates the probability for sound coming from a given incident angle or look-up direction and applies a time-varying, gain based, spatio-temporal filter for suppressing sounds coming from directions other than the sound source direction resulting in minimal artifacts and musical noise.

SUMMARY OF THE INVENTION

The present invention provides a system for enhancing acoustic performances of at least one acoustic source in an adverse acoustic environment. According to some embodiments of the invention, the system comprises: (i) an array of acoustic sensors, with each sensor having a different directivity; and (ii) an analysis module being configured for optimizing signal enhancement of at least one source, by correlating the sensors according to respective position of the at least one source in respect to the directivity of the acoustic sensors. The analysis is based on reflections from reverberating surfaces in the specific acoustic environment, allowing outputting a clean source-enhanced signal, wherein the optimization and sensors directivity allow maintaining the sensor array in compact dimensions without affecting signal enhancement and separation.

According to some embodiments, different directivity of each sensor is achieved by at least one of: (i) arranging the sensors in the array such that each is directed to a different direction; (ii) using sensors having different frequency sensitivity.

According to some embodiments, the analysis module computes a statistical estimate of a source signal using cross-correlation and auto-correlation of the signals from the acoustic sensors, containing both the desired source and a corrupting noise signal, using cross-correlation and auto-correlation of an interrupting noise signal alone, wherein the output estimate is given by using a minimum variance distortionless response (MVDR) beamformer.

According to some embodiments, the system further comprises a learning module configured for adaptive learning of the acoustic characteristics of the environment in which the acoustic sensors array is placed, for separating source signals from noise signals.

According to some embodiments, the array of acoustic sensors comprises multiple omnidirectional microphones, non-omnidirectional microphones, sensors having different frequency sensitivities, or a combination thereof.

According to some embodiments the system further comprises a multichannel analyzer for channeling thereby signals from each of the acoustic sensors. For example, the multichannel analyzer may be a multiplexer.

According to some embodiments the system further comprises at least one holder for holding the multiple acoustic sensors of the array.

In some embodiments, the holder is configured for allowing adjusting direction of each sensor and/or the number of sensors in the array.

According to some embodiments, the holder comprises acoustic isolating and/or reflecting materials.

According to some embodiments, each sensor in the array is bundled to at least one loud-speaker where the output of each loud-speaker is made such that interference, correlated to the bundled sensor, distorts the signals at other microphones for improving acoustic separation between the microphones in an active synthetic manner.

According to some embodiments, the system further comprises at least one audio output means for audio outputting the clean source enhanced signal.

According to some embodiments, at least one of the acoustic sensors in the array comprises at least one protective element and/or at least one directivity improving element.

According to some embodiments, the source signal is related to one of: human speech source, machine or device acoustic sound source, human sound source.

According to some embodiments, the system further comprises at least one additional remote acoustic sensor located remotely from the sensor array.

The present invention further provides a method for enhancing acoustic performances of at least one acoustic source in an adverse acoustic environment. The method, according to some embodiments thereof includes at least the steps of: (a) receiving signals outputted by an array of acoustic sensors each sensor having a different directivity; (b) analyzing the received signals for enhancement of acoustic signals from the at least one source, by correlating the received signals from the sensors, according to respective position of the at least one source in respect to the directivity of the acoustic sensors, the analysis being based on reflections from reverberating surfaces in the specific acoustic environment; and (c) outputting a clean source-enhanced signal, wherein the analysis and sensors directivity allow maintaining the sensor array in compact dimensions without affecting source-signal enhancement and signal separation.

According to some embodiments, the analysis comprises computing a statistical estimate of a speech signal using cross-correlation and auto-correlation of the signals from the acoustic sensors, containing both the desired source and a corrupting noise signals, using cross-correlation and auto-correlation of an interrupting noise signal alone, wherein the output estimate is given by using a minimum variance distortionless response (MVDR) beamformer.

According to some embodiments, the method further comprises the step of adaptively learning of the acoustic characteristics of the environment in which the acoustic sensors array is placed, for improving separating source signal from noise signal.

According to some embodiments, the method further comprises the step of learning the timing performances of the acoustic sensors in the array.

According to some embodiments, the different directivity of each sensor is achieved by at least one of: (i) arranging the sensors in the array such that each is directed to a different direction; (ii) using sensors having different frequency sensitivity.

BRIEF DESCRIPTION OF THE DRAWINGS

FIG. 6A illustrates how in an environment in which a single acoustic wave advances it can directly reach the sensors while parts thereof are reflected to the sensors from reflective surfaces in the environment; FIG. 6B shows input signals (in the frequency plane) inputted to one of the sensors in the environment; and FIG. 6C shows input signals (in the frequency plane) inputted to the other sensor.

FIG. 7A shows a microphones array holder having acoustically reflecting materials/surfaces embedded therein;

FIG. 7B shows a microphones array holder having glass acoustic reflecting materials combined with adhesive acoustic absorbing materials; and FIG. 7C shows a microphones array holder having metal based acoustic reflecting materials combined with adhesive acoustic absorbing materials.

DETAILED DESCRIPTION OF SOME EMBODIMENTS OF THE INVENTION

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention, in some embodiments thereof, provides methods and systems for enhancing acoustic performances of one or more acoustic sources in an adverse acoustic environment and particularly for enhancing the source(s) signals.

According to some embodiments, the system comprises: an array of acoustic sensors compactly positionable in different directivity in respect to one another; and an analysis module being configured for calculating and optimizing signal enhancement of the one or more sources, by correlating the sensors according to respective position of the source(s) in respect to the directivity of the acoustic sensors, based on reverberations from reverberating surfaces in the specific acoustic environment, wherein the optimization and sensors directivity allow maintaining the sensor array in compact dimensions without affecting speech enhancement and speaker separation.

The term "directivity" refers to the ability of the sensors and analysis of its output data to distinguish between acoustic signals arriving from different locations such as from the sound sources and/or from reflective surfaces. These reflected signals can originate from the sound source which the system aims to enhance such as one or more speakers' speech signals and from noise sources in the environment in which the system is located. This can be achieved, for example, by directing the sensors to the known or expected locations of noise and/or sound sources and/or to the reflective surfaces in the room. Another additional or alternative way to achieve directivity is by using sensors that have different frequency responsivity or sensitivity i.e. that respond better to one or more ranges of frequencies.

An additional or alternative manner to improve directivity of the sensors can be done by adding directing elements to the sensors array or holder thereof for enhancing reflected sound into the sensors in the array. This can be done, for instance: (i) by adding sound reflecting materials to the holder of the sensors arranged such as to direct acoustic signals reflected from the reflective surfaces in the room into the sensors of the array and/or (ii) by adding directing means such as fins to the sensors themselves.

Figure 3:
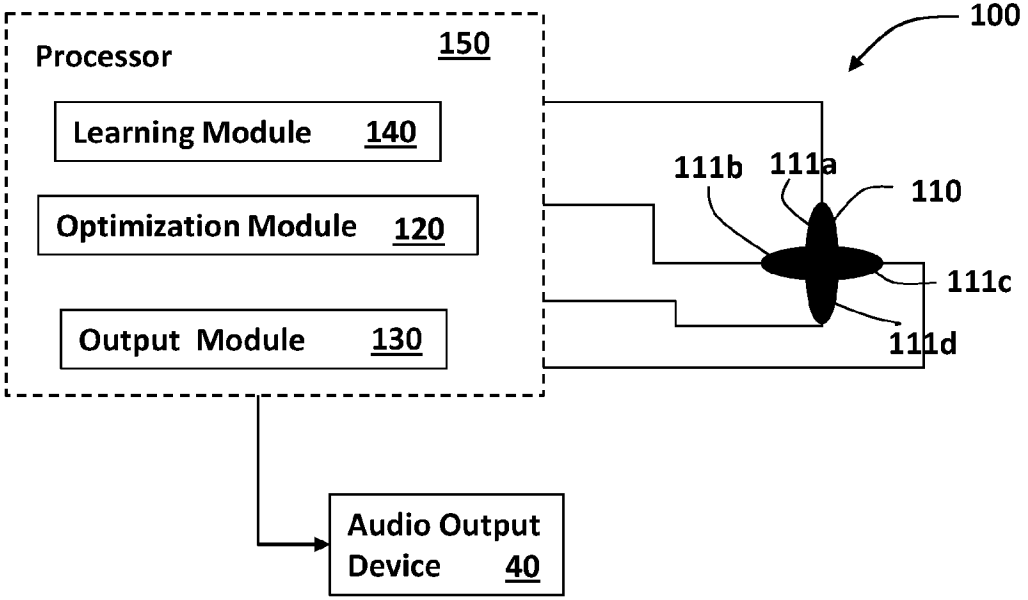
FIG. 3 shows a system for speech enhancement using a cross configuration microphone array, in which the microphones are positioned in different directivities in respect to one another, according to some embodiments of the present invention.

Reference is now made to FIG. 3, which is a block diagram illustrating a system 100 for speech enhancement of one or more human speaker sources, using an array of acoustic sensors such as microphone array 110 having four microphones 111*a*-111*d* arranged in a cross-like structure, according to some embodiments of the invention. The system 100 includes the microphone array 110, an analysis module 120 and an output module 130 operable through at least one processor such as processor 150.

According to some embodiments, the analysis module is configured to receive output signals from all the microphones 111*a*-111*d*, identify speech related signals of a speaker 10 from all microphones using reverberations information therefrom to enhance speech signal data outputting "speech data" that is indicative of the speaker's speech. The analysis module 120 can be adapted to also reduce noise from the signals by operating one or more noise reduction algorithms. The speech data produced by the analysis module 120 can be translated to audio output by the output module 130 for using one or more audio output devices such as speaker 40 to output the acoustic signals corresponding to the speech data.

For example, the analysis module 120 computes a statistical estimate of a speech signal using cross-correlation and auto-correlation of the signals from the four microphones 111*a*-111*d* containing both the desired speech and a corrupting noise signal and using cross-correlation and auto-correlation of an interrupting noise signal alone. The output estimate for this simple case is then simply given by the known MVDR beamformer.

According to some embodiments, as illustrated in FIG. 3, the system 100 further includes a learning module 140 allowing learning the acoustic characteristics of the environment in which the microphones array 110 is placed. The learning is performed in an adaptive manner in which the desired signal and the parameters are estimated. Statistics are adaptively adjusted in a different manner during noise periods and during signal mixed with noise periods, as required by the analysis module 120. The learning module 140 does not require repositioning of the microphone array 110 and/or adjusting directivity of the microphones 111*a*-111*d* in the room or any other environment.

According to some embodiment, the learning process may also include learning the timing performances of noise and/or of the sound sources that should be enhanced. For example static noise can be learned in terms of its frequencies and amplitudes and voice pitches and the like for improved enhancement and noise reduction. The system may also be configured for timing (synchronizing) sensors' activation or performances according to the known learned sound sources and/or noise timing data.

Figure 1:
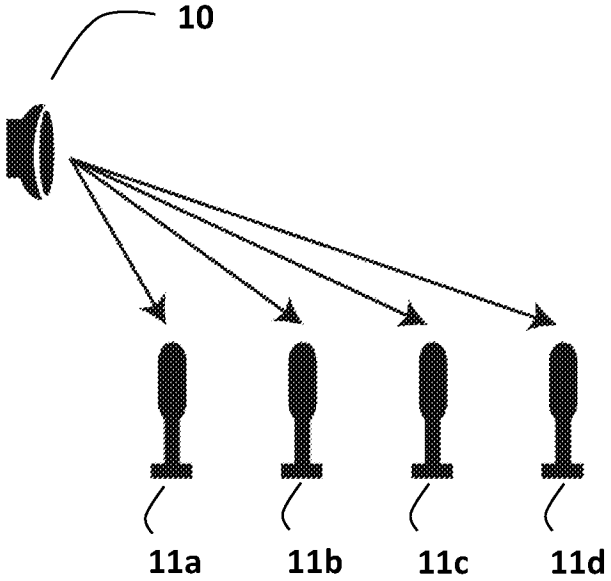
Fig. 1 (Prior Art)
FIG. 1 shows a prior art configuration for microphone array consisting of four microphones with equal distances therebetween. The array is designed to enable speech enhancement. Since the band of 200-1000 Hz is crucial for speech intelligibility, when only the direct arrival is considered—reducing the total array length severely affects the performance.
Figure 2:
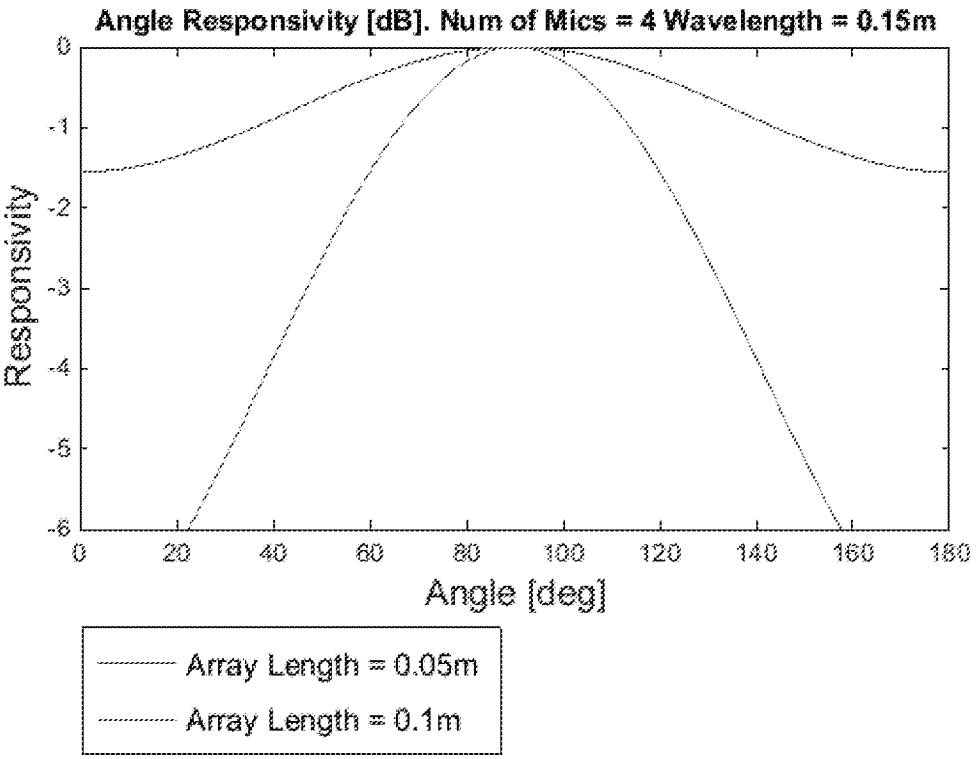
Fig. 2 (Prior Art)
FIG. 2 shows azimuth gain of the prior art array shown in FIG. 1.

The performance of linear arrays with omnidirectional microphones is severely affected by the reduction of the total array size as in FIG. 2. Unlike in linear arrays, when reverberation is used, it is much more complicated to analyze the performance Vs. the size of the array. However, as is evident from Affes et al. (1997), using reflections improves the performance as compared to analysis that is based only on the direct arrival. The directivity of the sensors in the array 110 is crucial for optimizing utilization of reflections from the surfaces of the acoustic environment. For this reason, designing a general purpose array for fitting most acoustic environments, the maximum spatial directivity separation and differentiation between the acoustic sensors of an array can be designed depending on the number of sensors per array. For example, for an array including four microphones a tetrahedral relation between the sensors can be implemented whilst for six microphones a cubical relation wherein the sensors' heads form vertices of a cubical or a tetrahedron respectively. The sensors can be arranged over a holder for keeping them in their optimal positioning in respect to one another, where the holder can be configured such as to allow readjustment of the sensors positioning or configured such that the sensors can only be fixedly held thereby.

According to some embodiments, inevitable differences between the directivity of omnidirectional microphones of the array 110 may be used. A system compromising microphones that are generally regarded as "Omnidirectional" is also in the scope of this invention.

The system can be designed according to the environment/space in which it should be installed. For instance, if the system is to be used in a car, the microphones can be arranged according to the positioning (direction) of the driver (assumed as main speaker), the person seated next to the driver, and the reflecting surfaces in the vehicle. If the array would be placed on a table—microphones may cover the half-sphere heading the upward direction. The microphones array can be arranged to collect as much of the desired sources considering the possible location(s) of the speaker(s) and the reverberating surfaces of the environment.

According to some embodiments, the signal data from the microphones 111*a*-111*d* can be channeled to the processor 150 through a multichannel analyzer device such as a multiplexer device or any other known in the art devices that can channel signals from multiple sensors or detectors to a processing means by combining the signals into a single signal or simply channeling each sensor data separately. One example for such device is STEVAL-MK1126Vx demonstration board by STMicroelectronics.

Figure 4:
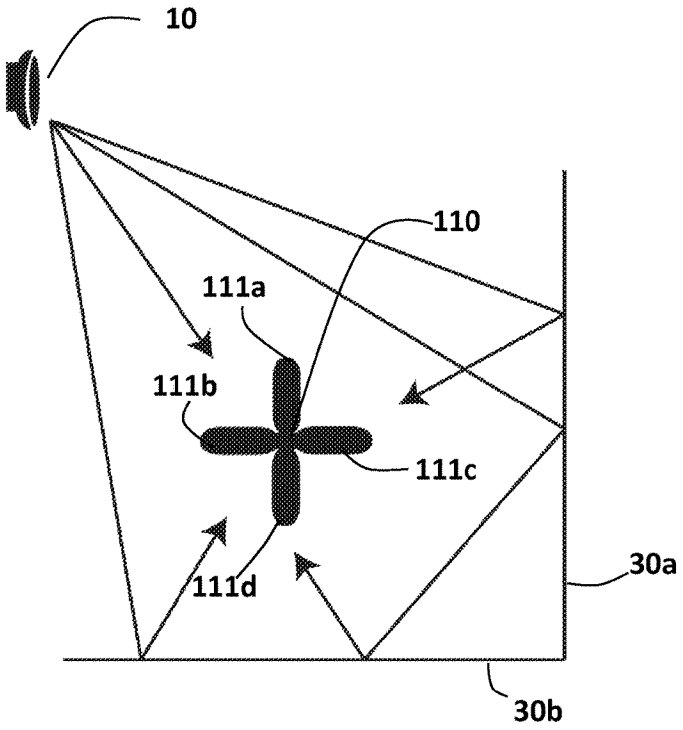
FIG. 4 illustrates how reverberations in a specific acoustic environment are detected through the microphones of the system, according to one embodiment of the invention.

FIG. 4 illustrates how reflections from surfaces 30*a* and 30*b* in a specific acoustic environment such as a room are received by the microphone array 110 of the system 100, according to one embodiment of the invention. One can see from FIG. 4 that the microphones 111*c* and 111*d* which are typically close to one another, receive different reflections, due to the directivity of the microphones.

Figure 5:
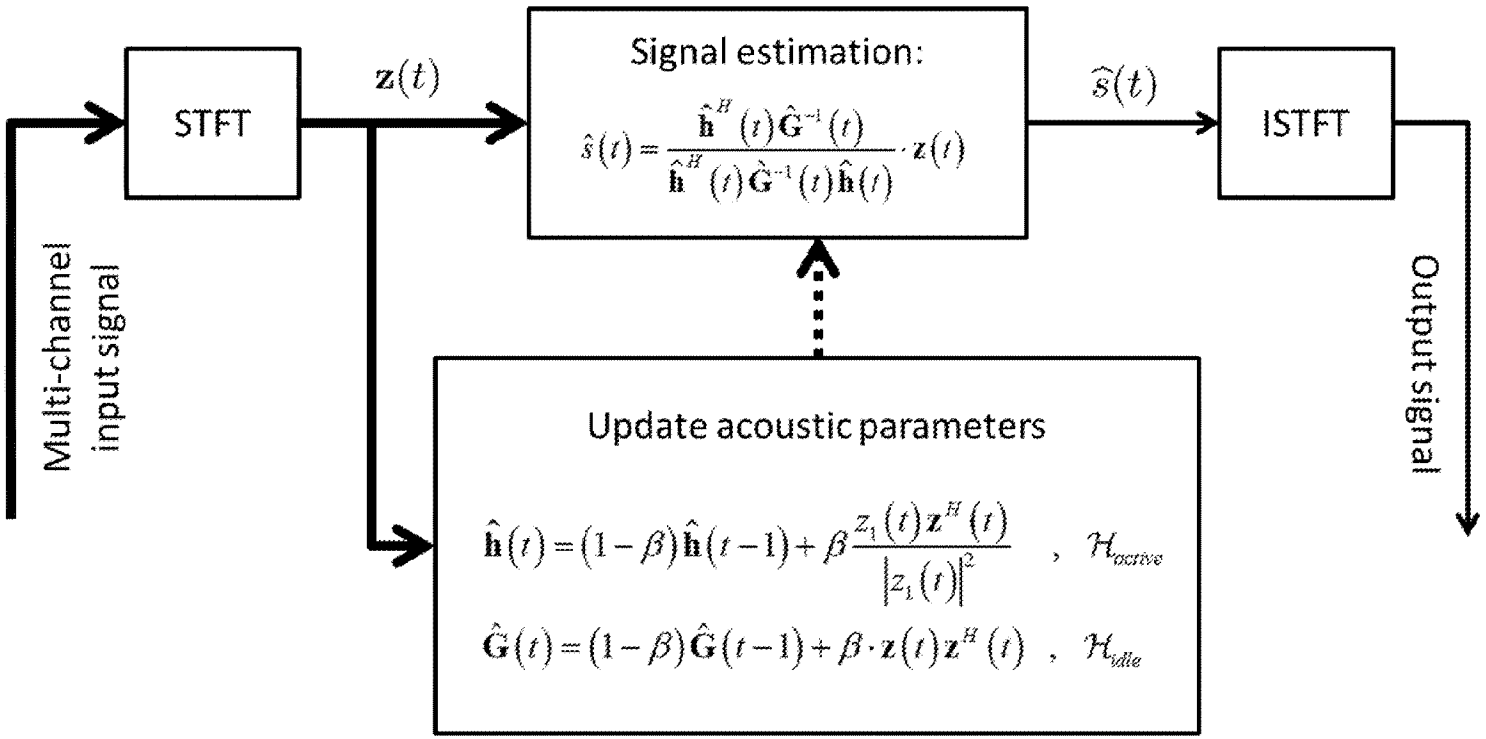
FIG. 5 shows the optimization processing equations for speech enhancement of the system, according to some embodiments of the invention.
Figure 6B:
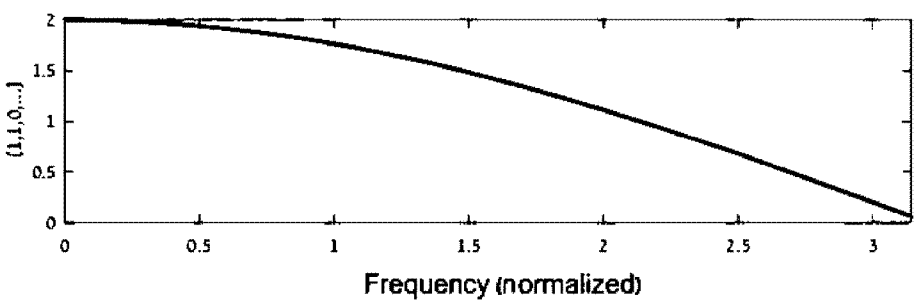
FIGS. 6A-6C show how sensors with different frequency sensitivity can be used for achieving directivity of the sensors array of the system, according to some embodiments of the invention.
Figure 6C:
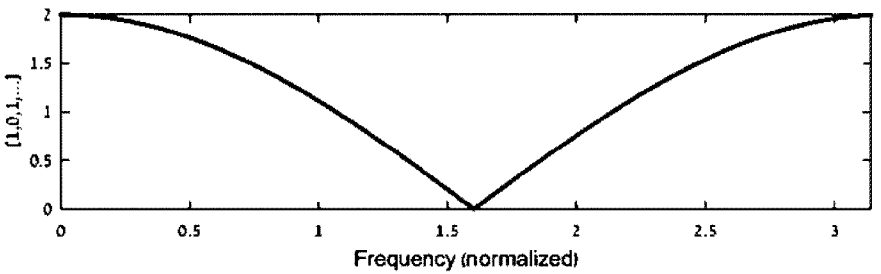
Figure 6A:
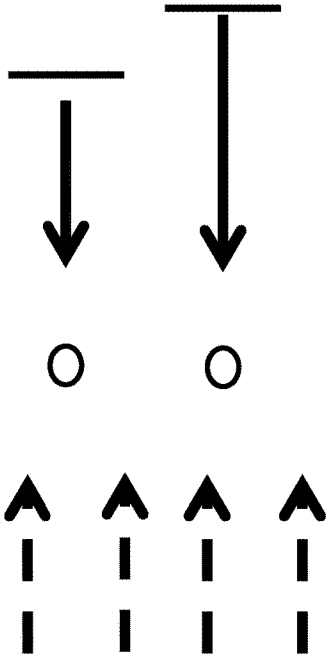

FIG. 5 shows the basics of an example algorithm for speech detection in a noisy environment using data from the microphone array of the present invention, according to some embodiments of the invention, according to which both the environment's acoustic parameters of the environment as well as the speech signals are estimated. The algorithm is operated in the time-frequency domain after the microphones signals have been transformed e.g. through a FFT transformer. The same calculation is performed for each frequency band.

In the equations shown in FIG. 5:

"t" indicates the time frame index, the frequency index is omitted for brevity.

$z(t)=[z_1(t), z_2(t) \ldots z_J(t)]^T$—J-channels input signal in timeframe t $v(t)=[v_1(t), v_2(t) \ldots v_J(t)]^T$—noise signal s(t)—clean speech signal $\hat{s}(t)$—single channel output signal $h=[h_1, h_2 \ldots h_J]^T$—acoustic transfer function G—J×J noise covariance matrix $H_{active}$—speech active hypothesis $H_{idle}$—speech non-active hypothesis The frequency index was omitted to simplify the presentation. The statistical model is $z(t)=h\cdot s(t)+v(t)$. Whereas s(t) is the desired speech signal, h is the acoustic system between the desired source and each of the acoustic sensors and v(t) is the noise signal as depicted by the sensors. The algorithm is designed to estimate s(t) from the noisy measurements. The covariance matrix of v(t) is G.

The Processing Steps:

In the first step, new measurement z(t) is received by the processing system for each frequency band. For each frequency band of each measurement:

(i) the source signal is calculated by the cross product between the input signal and the multi-channel filter referred to hereinafter as the "Capon filter" (see filter suggested by Capon, 1969) i.e.:

$$w = \frac{\hat{h}^H \hat{G}^{-1}}{\hat{h}^H \hat{G}^{-1} \hat{h}}$$

The Capon, 1969 filter is designed to minimize the noise, while preserving the desired signal (speech signal in this case) without distortion.

(ii) Identification of speech related components in z(t): to estimate the acoustic system h and the covariance matrix G, it must be determined whether the speech signal s(t) is active or whether there is no speech activity within the respective time-frequency frame being analyzed. Respectively, the acoustic system s(t) and matrix G are estimated by using the idle or active hypotheses.

The above steps of (i) and (ii) are repeated for each timeframe or frequency.

The output of the process illustrated in FIG. 5 is the estimated enhanced speech signal s(t), which will then be translated into an acoustic speech signal for outputting thereof through audio output means.

In some embodiments of the invention, the system also uses one or more remote acoustic sensors such as remote microphones located remotely from the sensor array for improving system performances. For example, the one or more remote microphones can be located in proximity to one or more respective noise sources in the room.

Physical location of the microphones or any other combination of sensors in the array and optionally the location of one or more remote sensors if such are used should include as much information as possible indicative of noise or signal source. For example it is possible to locate only one microphone or any other type of sound responsive sensor (i.e. optical microphone, MEMS (microelectronic mechanical system) accelerometer, other vibration sensor) such that one or more of the noise sources or signal sources are inputted with high direct sound arrival. Direct arrival of sound that did not undergo reflection could gain better SNR. The sensors therefore can be arranged in a way that they are facing outwardly. For example, on a sphere, cube or any other arbitrary shape of the holder thereof.

The spacing between the sensors in the array determined by the dimensions and shape of the holder thereof, can be even or uneven and can vary depending on system requirements which may depend for instance on the room size, locations of reverberating surfaces and the one or more sources and the like.

The holder may also be designed to allow changing the distances between the sensors in the array for adjusting the array to requirements of the system depending for instance on the location number of reflecting surfaces in the room, noise sources locations, speakers locations etc.

In case of one or more human speakers, each speaker can be either man or woman and the noise sources are either stationary or non-stationary, for example other speakers and/or constant stationary machine noise such as air conditioning device noise. In several cases, the proposed sensor array with four microphones could separate between the desired speakers with low SNR of residual noise. However, if 8 microphones are used, the quality of voice separation between human speakers and noise reduction of the interfering noise will be improved considerably to a level in which human listeners will be able to easily make a conversation, or operate voice recognition devices.

Although it is very general to say that more microphones are better. In a well-controlled environment, in which the number of noise sources is known, it may be required to have one or more microphones than the number of noise/speech sources. So for example, assuming very well controlled environment, five microphones will be required for achieving the best performance with the least amount of microphones for four signal sources and another microphone for releasing constraints and optimization.

The sensor array can be held by one or more holders or holding devices allowing easy arrangement of the sensors and easy directivity adjustment. The holder may also improve directivity of the sensors array and/or sound separation by having acoustic isolating, acoustically reflecting and/or separating materials located between adjacent sensors such as sound reflecting and/or absorbing materials.

Figure 7B:
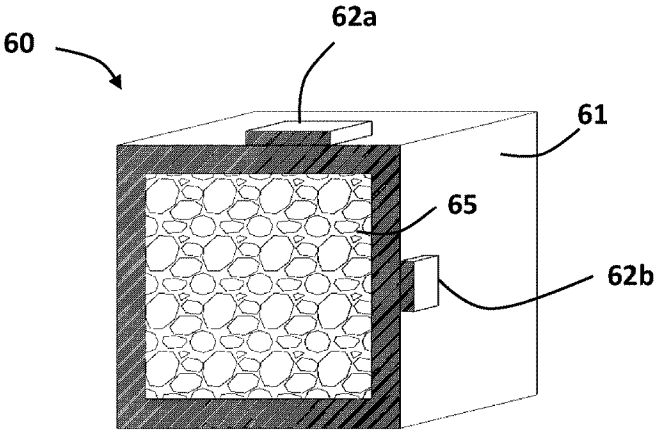
FIGS. 7A-7C show holders for sensors arrays having different acoustic directivity and/or isolation improving materials embedded therein, according to some embodiments of the invention.
Figure 7C:
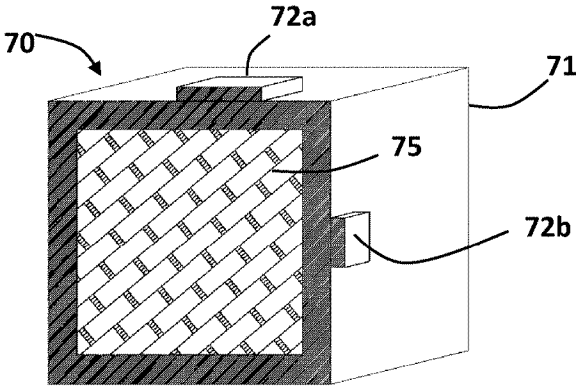
Figure 7A:
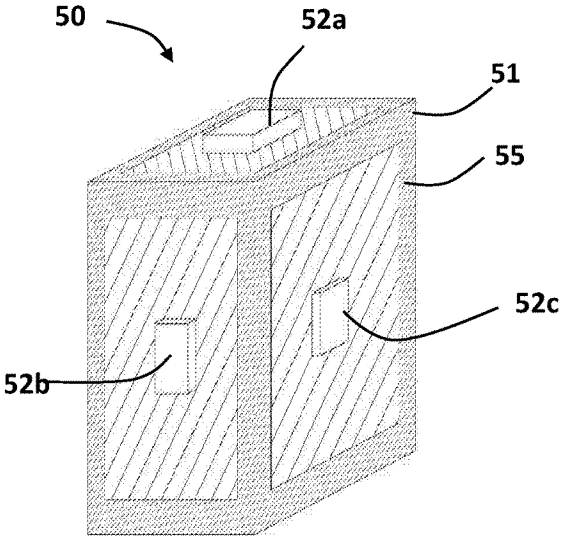

Reference is now made to FIGS. 7A, 7B and 7C showing microphone arrays 50, 60 and 70 held by holders 51, 61 and 71 respectively each holder including a different type of sound source detection improving materials 55, 65 and 75. In the first example of holder 51 in FIG. 7A the microphones 52*a*-52*c* are separated by an acoustic reflecting material such as glass. The glass walls between the microphones may serve as additional inner sound reflecting surfaces thereby improve identification of reverberations originating from the speech and/or noise sound sources in the room. In the second and third examples of holders 61 and 71 the microphones 62*a*-62*b* and 72*a*-72*b* are separated by a combination of acoustic reflecting materials and acoustic absorbing materials such as glass bids embedded in polymeric adhesive (such as in the separating material 65 shown in FIG. 7B) or a metal mesh with polymeric adhesive (such as in the separating material 75 shown in FIG. 7C).

An additional or alternative way for achieving sensors separation will be by using active noise cancelling. For example consider an array of two microphones. Each microphone is associated with a nearby loudspeaker when the loudspeaker operates at different phase to its respective associated microphone. By destructive interference, the microphones will not "hear" the same sound.

Removing Ambient Direct Pressure Such as Wind Noise Direct Hit:

Wind noise can directly hit the microphone diaphragm and cause overload of the circuits that cannot be digitally removed. Therefore it may be beneficial to add a protective element such as fur or metal mesh to break down the wind direct hit of the sensors without affecting the desired sound. For example, it is also possible to design each sensor in the array in a way that the sensor is covered externally by a protective element. This will remove direct sound arrival therefore this will be on the expanse of performance, but will improve the robustness of the sensor outdoors. Another option is acoustic pipes. Acoustic pipes can physically protect the microphone openings, but that will be on the expanse of performance at higher frequencies due to the dispersive nature of acoustic waveguides.

According to some embodiments, each microphone opening may have a shaped entrance. The shaped entrance may distort the frequency response of the input audio signal in a predicted or desired manner. For example, cone shaped entrance with large enough diameter compared to the size of the microphone membrane will have negligible effect while small diameter entrance canal will have some distortion due to resonance in higher frequencies. While the diameter of the canal determines the magnitude of the effect, the frequency resonance is mainly determined by the length of the canal, for example, the first peak frequency resonance is given by $f=c/4L$.

According to some embodiments of the invention, the system may include and/or use one or more devices or algorithms for sampling the sensors of the sensor array and for synchronizing these sensors. This may be used for compensating and/or calibrating the sensors operation. A single clock line may be used for all microphones in a way that the clock signal reaches all the microphones at the same time. Another possibility is to perform a preliminary calibration process in which the time delays between the sensors are measured and then the measurements are used for compensation in the analysis stage.

Using Buried Microphones: The microphones are typically positioned in a way that the microphones are facing outwardly towards the room. However, it is possible to cover the microphones in material that causes multiple reflections in a way that the reflections are causing different responses due to differences in directions of arrival from the room. The material (or mesh) is making a mix of sound impinging a larger portion of space than the sensor would normally would. So the benefit is that instead that the sensor microphones will sample few points in space, it will sample a larger volume of space. The mesh can be made from heavy and/or high impedance materials. The small parts of the mesh can be larger than the acoustic wavelength and in some embodiments smaller than the acoustic wavelength.

Figure 8:
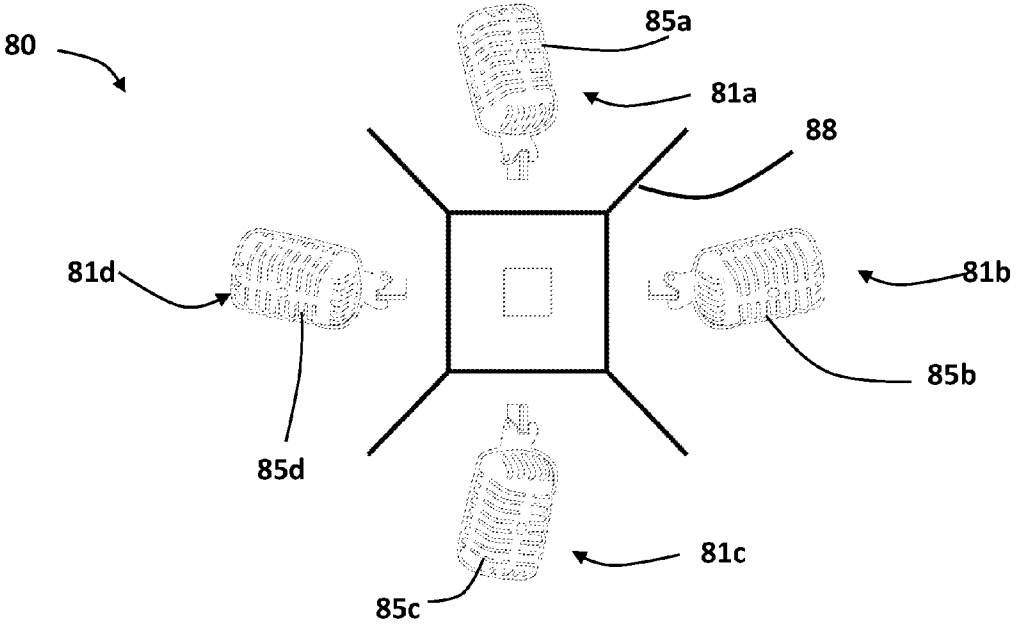
FIG. 8 shows a holder holding a microphones array in which each microphone is covered by a protective cover and the holder includes directing fins for improved directivity, according to one embodiment of the invention.

Reference is now made to FIG. 8 showing a four-microphone array 80 and holder 88 thereof where each of the microphones 81*a*, 81*b*, 81*c* and 81*d* is covered by a protective cover 85*a*, 85*b*, 85*c* and 85*d*, respectively.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments and/or by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Although the invention has been described in detail, nevertheless changes and modifications, which do not depart from the teachings of the present invention, will be evident to those skilled in the art. Such changes and modifications are deemed to come within the purview of the present invention and the appended claims.

REFERENCES

1. Affes Sofiene and Grenier Yves, "A Signal Subspace Tracking Algorithm for Microphone Array Processing of Speech", IEEE Transactions on Speech and Audio Processing, Vol. 5, NO. 5, September 1997.
2. Jan Ea-Ee and Flanagan James, "Sound Capture from spatial Volumes: Matched-Filter Processing of Microphone Arrays Having Randomly Distributed Sensors", pp. 917-920, 1996.
3. Capon, J. "High-resolution frequency-wavenumber spectrum analysis". Proceedings of the IEEE 57, pp. 1408-1418, 1969.

The invention claimed is:

1. A system for enhancing acoustic performances of at least one acoustic source in an adverse acoustic environment, said system comprising:

an array of acoustic sensors, wherein each acoustic sensor of said array of acoustic sensors has a different directivity; and at least one processor comprising an analysis module, said analysis module is configured with instructions to:

receive output signals from the array of acoustic sensors, said output signals include source signals, reverberations signals, and noise signals;

identify speech related signals comprising said reverberations signals of the at least one acoustic source from said array of acoustic sensors using idle or active hypotheses methods; and correlate each acoustic sensor of said array of acoustic sensors based on the identified speech related signals to output a clean source-enhanced signal.

2. The system according to claim 1, wherein said different directivity of said each acoustic sensor is achieved by at least one of: (i) arranging the sensors in the array such that each is directed to a different direction; (ii) using sensors having different frequency sensitivity.

3. The system according to claim 1, wherein said analysis module computes a statistical estimate of said source signals using cross-correlation and auto-correlation of the received output signals from the acoustic sensors, containing both desired source signal and a corrupting noise signal, using cross-correlation and auto-correlation of an interrupting noise signal alone, wherein the output estimate is given by using a minimum variance distortionless response (MVDR) beamformer.

4. The system according to claim 1, wherein said at least one processor further comprising a learning module configured with instructions to:

estimate the desired signal and the parameters of the at least one acoustic source;

adaptively learn the acoustic characteristics of the environment in which the acoustic sensors array is placed; and separate the source signals from the noise signals.

5. The system according to claim 1, wherein said array of acoustic sensors comprises multiple omnidirectional microphones, non-omnidirectional microphones, sensors having different frequency sensitivities, or a combination thereof.

6. The system according to claim 1, wherein said received output signals are further channeled via a multichannel analyzer for channeling thereby the output signals from each of the acoustic sensors to said at least one processor.

7. The system according to claim 6, wherein said multichannel analyzer is a multiplexer.

8. The system according to claim 1, further comprising at least one holder for holding said multiple acoustic sensors.

9. The system according to claim 8, wherein said holder is configured for allowing adjusting direction of each sensor and/or the number of sensors in the array.

10. The system according to claim 1, wherein each acoustic sensor in said array of acoustic sensors is bundled to at least one loud-speaker where the output of each loud-speaker is made such that interference, correlated to the bundled sensor, distorts the signals at other microphones for improving acoustic separation between the microphones in an active synthetic manner.

11. The system according to claim 1, further comprising at least one audio output means for audio outputting the clean source enhanced signal.

12. The system according to claim 1, wherein at least one of the acoustic sensors in the array comprises at least one protective element and/or at least one directivity improving element.

13. The system according to claim 1, wherein said acoustic source is related to one of: human speech source, machine or device acoustic sound source, human sound source.

14. The system according to claim 1, further comprising at least one additional remote acoustic sensor located remotely from the array of acoustic sensors.

15. A method for enhancing acoustic performances of at least one acoustic source in an adverse acoustic environment, said method comprising at least the steps of:

receiving output signals, said output signals include source signals, reverberations signals and noise signals, by an at least one processor from an array of acoustic sensors, wherein each acoustic sensor of said array of acoustic sensors having a different directivity;

identifying by an analysis module of said at least one processor, speech related signals comprising said reverberations signals of the at least one acoustic source from said array of acoustic sensors using idle or active hypotheses methods;

correlating each acoustic sensor of said array of acoustic sensors based on the identified speech related signals and according to respective position of said at least one acoustic source to output a clean source-enhanced signal.

16. The method according to claim 15, wherein said analysis module is configured with instructions to compute a statistical estimate of said source signals using cross-correlation and auto-correlation of the received output signals from the acoustic sensors, containing both the desired source and a corrupting noise signals, using cross-correlation and auto-correlation of an interrupting noise signal alone, wherein the output estimate is given by using a minimum variance distortionless response (MVDR) beamformer.

17. The method according to claim 15, further comprising adaptively learning of the acoustic characteristics of the adverse acoustic environment in which the array of acoustic sensors is placed, for improving the separation of source signal from noise signal at the clean source-enhanced signal.

18. The method according to claim 17, further comprising learning the timing performances of the acoustic sensors in the array of acoustic sensors.

19. The method according to claim 15, wherein said different directivity of each sensor is achieved by at least one of: (i) arranging the sensors in the array such that each is directed to a different direction; (ii) using sensors having different frequency sensitivity.

20. A method for enhancing acoustic performances of at least one acoustic source in an adverse acoustic environment, said method comprising at least the steps of:

receiving output signals, said output signals include source signals, reverberations signals and noise signals, by an at least one processor from an array of acoustic sensors, wherein each acoustic sensor of said array of acoustic sensors having a different directivity;

identifying by an analysis module of said at least one processor, speech related signals comprising said reverberations signals of the at least one acoustic source from said array of acoustic sensors using idle or active hypotheses methods;

correlating each acoustic sensor of said array of acoustic sensors based on the identified speech related signals and according to respective position of said at least one acoustic source to output a clean source-enhanced signal, wherein said analysis module is further configured with instructions to: compute a statistical estimate of said source signals using cross-correlation and auto-correlation of the received output signals from the acoustic sensors, containing both the desired source and a corrupting noise signals, using cross-correlation and auto-correlation of an interrupting noise signal alone, wherein the output estimate is given by using a minimum variance distortionless response (MVDR) beamformer.

* * * * *